United States Patent [19]

Okamoto et al.

[11] Patent Number: 4,739,181

[45] Date of Patent: Apr. 19, 1988

[54] STARTING MOTOR WITH EPICYCLE REDUCTION GEAR

[75] Inventors: Kyoichi Okamoto; Hiroyuki Morikane; Takemi Arima, all of Hyogo, Japan

[73] Assignee: Mitsubishi Denki Kabushiki Kaisha, Tokyo, Japan

[21] Appl. No.: 49,911

[22] Filed: May 15, 1987

[30] Foreign Application Priority Data

May 15, 1986 [JP] Japan ..... 61-74170[U]

[51] Int. Cl.[4] ..... F02N 15/06

[52] U.S. Cl. ..... 290/38 R; 290/48; 74/7 R; 74/801; 310/83

[58] Field of Search ..... 290/38 R, 38 A, 38 B, 290/38 C, 48, 37; 74/7 R, 7 A, 7 B, 7 C, 7 E, 84 R, 801, 710, 710.5, 447; 123/179 E, 228; 310/83, 52, 54; 464/38

[56] References Cited

U.S. PATENT DOCUMENTS

| | | | |
|---|---|---|---|
| 4,367,424 | 1/1983 | Presley | 310/83 X |
| 4,503,719 | 3/1985 | Hamano | 74/7 E |
| 4,520,285 | 5/1985 | Isozumi et al. | 310/83 |
| 4,528,470 | 7/1985 | Young et al. | 310/83 X |
| 4,587,861 | 5/1986 | Morishita | 310/83 X |
| 4,609,841 | 9/1986 | Masaki et al. | 310/83 X |
| 4,635,489 | 1/1987 | Imamura et al. | 74/7 E |
| 4,671,125 | 6/1987 | Yabunaka | 290/48 X |
| 4,680,979 | 7/1987 | Morishita et al. | 310/83 X |

FOREIGN PATENT DOCUMENTS

| | | |
|---|---|---|
| 108068 | 7/1986 | Japan . |
| 2109893 | 10/1982 | United Kingdom . |

*Primary Examiner*—William M. Shoop, Jr.
*Assistant Examiner*—Paul Ip
*Attorney, Agent, or Firm*—Sughrue, Mion, Zinn, Macpeak & Seas

[57] ABSTRACT

A starting motor comprising an epicycle reduction gear, a sun gear installed at the end of the rotary shaft of a driving motor, a plurality of planet gears engaging with the sun gear, a flange for supporting the planet gears, and an internal gear having cylindrical means including an output shaft driven by the revolution of the planet gears and a gear formed on the inner peripheral face thereof, the gear engaging with the planet gears, and a side plate extended from the cylindrical means in the diametric direction and positioned opposite to the flange, a pinion capable of sliding on the output shaft, a bearing surface being formed on either the flange or side plate to allow the opposite contact to slide thereon and a recess filled with grease being provided in the bearing surface.

5 Claims, 2 Drawing Sheets

STARTING MOTOR WITH EPICYCLE REDUCTION GEAR

BACKGROUND OF THE INVENTION

Industrial Field of the Invention

The present invention relates to a starting motor fitted with an epicycle reduction gear for starting an internal combustion engine of an automobile or the like and more particularly to the improvement including means for preventing the outer end face of a flange from wearing off, the flange being fitted to an output shaft on the inner side plate of its internal gear.

Prior Art

FIG. 5 is a vertical sectional view of the principal part of a conventional starting motor of the sort fitted with an epicycle reduction gear. In FIG. 5, there is shown a magneto D.C. motor 1 as a driving motor comprising a yoke 2 with an end plate 3 incorporated into or fitted to the front end thereof; a pole iron core 4 composed of a permanent magnet attached to the yoke 2; an armature core 5 fitted into an armature coil 6 and fixed to a rotary shaft 7; a commutator 8 fixed to the rotary shaft 7; a rear bracket 9 attached to the yoke 2 and employed to support the rear end of the rotary shaft 7 through a bearing 10; and a brush 11.

The magneto D.C. motor 1 also includes a front bracket 12 attached to the yoke 2; an output shaft 13, a flange 14 provided at one end of the output shaft 13, the other end thereof being supported with the front bracket 12 through a sleeve bearing 15; a support hole **13*a* bored in the axis of the output shaft 13; a stopper 16 fitted to the output shaft 13 and used to stop a pinion 27 from moving toward the other end thereof; a sleeve bearing 17 fitted into the support hole 13*a* for receiving the end of the rotary shaft 7; and a steel ball 18 installed in between a tapered center hole 7*a* and a tapered center hole 13*b* provided at the bottom of the support hole 13*a* and used to stop the output shaft 13** toward the one end thereof.

The magneto D.C. motor still includes an epicycle reduction gear 19 comprising a sun gear 20 formed at the end of the rotary shaft 7; a plurality of planet gears 21 engaging with the sun gear 20 and supported with a support pin 22 fixed to the flange 14 through a sleeve bearing 23; an internal gear 24 composed of plastic material such as fiber reinforced plastics offering greater mechanical strength, supported with the front bracket 12, regulated to a fixed extent of revolution and used to let the rotating planet gears 21 revolve, the internal gear 24 supporting the one end of the output shaft 13 through a sleeve bearing 25.

The magneto D.C. motor further includes an overrunning clutch 26 helical-spline coupled to the output shaft 13 and used to support the pinion 27 so that the pinion 27 can transfer torque in one direction.

Numeral 28 indicates a steel washer applied between the flange 14 and the side plate **24*a* of the internal gear 24 and so arranged as to prevent the inner end face of the side plate 24*a*** from wearing off.

FIGS. 3, 4 shows the internal gear 24 to which the washer 28 has been applied, wherein either revolution resulating projection **24*c* is fitted into a support groove 12*a* (see FIG. 5) provided in the front bracket 12 and used to stop the revolution of the internal gear 24. Each cutout for a through bolt 24*d* is used to couple the front bracket 12 to the yoke 2**.

The operation of the aforesaid conventional apparatus is as follows: When the D.C. motor 1 is started, the rotary shaft 7 rotates and the sun gear 20 causes the planet gears 21 to rotate and engage with the fixed internal gear, whereby the torque is transmitted to the output shaft 13. At this time, the overrunning clutch 26 has been pushed forward by the operation of the magnetic switch of the starting motor through a shift lever (both are not shown) and, because its pinion 27 has engaged with the ring gear of the flywheel of the engine, the engine is started.

Problems to be Solved by the Invention

In the aforesaid conventional starting motor fitted with an epicycle reduction gear, the washer 28 is inserted between the flange 14 and the side plate of the internal gear 24 and the friction of the washer 28 tends to produce abnormal sound while the aforesaid motor is operated.

In addition to the aforesaid problem, an excessive washer 28 or no washer 28 maybe supplied by mistake.

SUMMARY OF THE INVENTION

The present invention is intended to solve the above problems and it is therefore an object to the invention to provide a starting motor fitted with an epicycle reduction gear for nullifying abnormal sound derived from a washer and preventing the side plate of its internal gear from wearing off as in the case of an conventional apparatus.

Means of Solution of the Problems

In the starting motor fitted with an epicycle reduction gear according to the present invention, an annular washer is attached to the side plate of an internal gear opposite to a flange installed for the output shaft thereof and a recess for grease storage is formed in the washer surface.

Function

When the motor is started according to the present invention, the internal gear is caused by the annular washer to slide on the inner end face of the flange of the output shaft with the aid of the grease, so that not only the generation of abnormal sound but also abrasion is prevented.

BRIEF DESCRIPTION OF THE DRAWINGS

FIGS. 3, 4 are elevational and side sectional views of the internal gear;

FIG. 5 is a vertical sectional view of the starting motor.

PREFERRED EMBODIMENT OF THE PRESENT INVENTION

Figure 5:
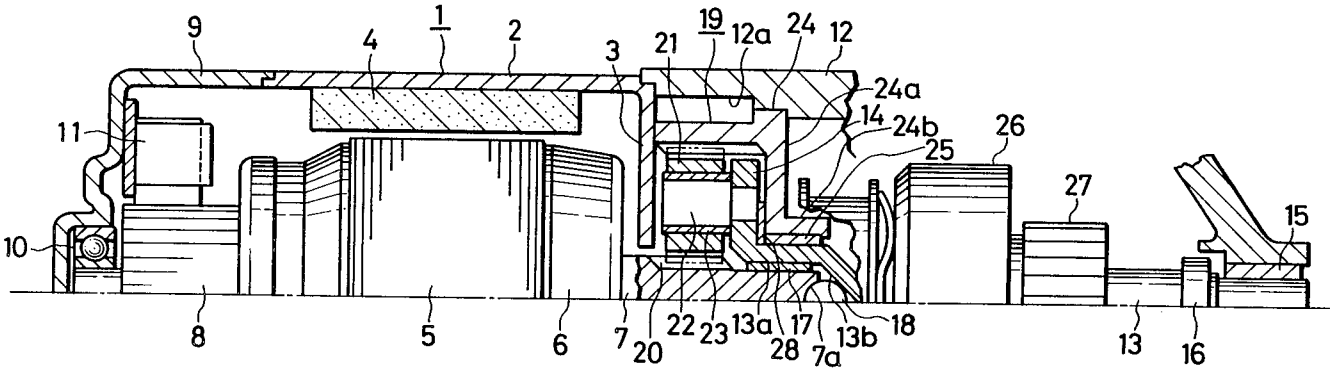

The starting motor with an epicycle reduction gear according to the present invention is similar to what is shown in FIG. 5 as a conventional one except that the former includes an improved version of the internal gear without a washer and therefore the internal gear will be described.

Figure 1:
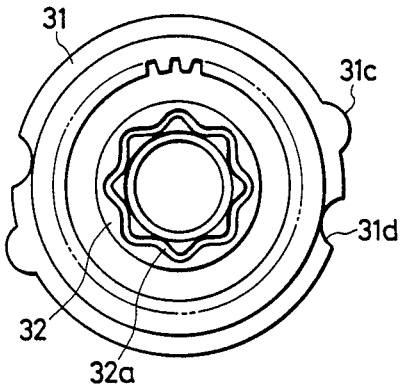
FIGS. 1, 2 are elevational and side sectional views of an internal gear contained in a starting motor with an epicycle reduction gear embodying the present invention, respectively.
Figure 2:
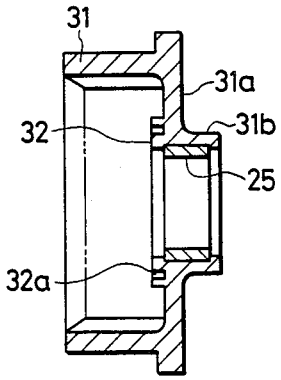
Figure 3:
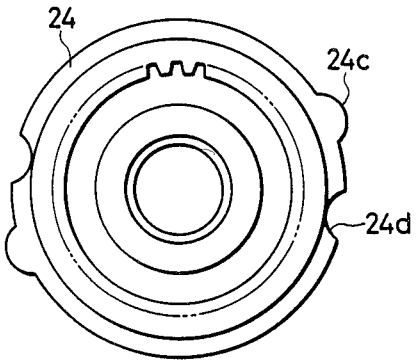
FIGS. 3 through 5 show a conventional starting motor with an epicycle reduction gear.
Figure 4:
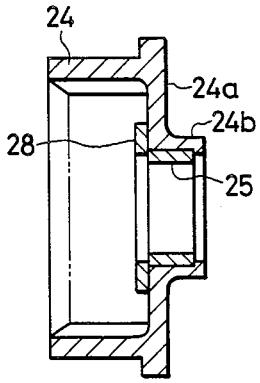

FIGS. 1, 2 are elevational and side sectional views of an internal gear embodying the present invention, respectively. In FIGS. 1, 2, there is shown an internal gear composed of plastic material such as fiber reinforced plastics offering greater mechanical strength, the internal gear comprising a side plate 31*a* and a boss 31*b* as those integrally molded, and an annular washer 32 arranged opposite to the face of a flange 14 (see FIG. 5). A conventionally used washer 28 can thus be dispensed with. A waveform groove 32*a* for use as a recess for grease storage is formed in the face of the annular washer 32, the groove 32 being filled with grease. A sleeve bearing 25 is buried in the inner periphery of the boss 31*b*. The internal gear also includes revolution regulating projections 31*c* and cutouts 31*d* for receiving through-bolts for coupling a front bracket 12 to a yoke 2.

As the recess for grease storage, an annular groove or holes for grease storage arranged in a plurality of places maybe provided.

In the aforesaid motor as an embodiment of the present invention, the end face of the flange 14 is caused to slide on the face of the annular washer 32 of the internal gear 31 and received thereby when the output shaft 13 is rotated as the motor is started. However, with the aid of grease, not only the production of abnormal sound but also the abrasion of the end face thereof can be prevented because the frictional resistance thereof is reduced.

Although reference has been made in the aforesaid embodiment to the magneto D.C. motor 1, the magnetic poles maybe obtained from field winding.

Although it has been arranged in the aforesaid embodiment that the front end of the rotary shaft 7 in the aforesaid embodiment is supported, through the sleeve bearing 17, with the output shaft 13 supported with the internal gear 31 through the sleeve bearing 25, a boss may further be installed on the end plate of the yoke 2 to support the front end of the rotary shaft 7 through a bearing. In this case, an intermediate bracket, in place of the end plate 3 may be fitted to the yoke.

When the front end of the rotary shaft 7 is supported with the end plate 3 or the intermediate bracket through the bearing, the sleeve bearing 25 of the internal gear 31 can be dispensed with.

Effect of the Invention

As set forth above, the annular washer is attached to the side plate of the internal gear opposite to the flange installed for the output shaft thereof and the recess for grease storage is formed in the washer surface in the starting motor fitted with an epicycle reduction gear according to the present invention, whereby the flange is allowed to slide on the annular washer on the side plate of the internal gear with the aid of grease. In consequence, not only the production of abnormal sound but also abrasion can be prevented because the frictional resistance is reduced. Moreover, defectives attributed to the insertion of washers in error can be avoided.

What is claimed is:

1. A starting motor fitted with an epicycle reduction gear, said starting motor comprising an epicycle reduction gear having a driving motor, a sun gear installed at the end of the rotary shaft of said driving motor, a plurality of planet gears engaging with said sun gear and driven thereby, a flange for supporting said planet gears, and an internal gear having cylindrical means including an output shaft driven by the revolution of said planet gears and a gear formed on the inner peripheral face thereof, said gear engaging with said planet gears, and a side plate extended from said cylindrical means in the diametric direction and positioned opposite to said flange;

a pinion capable of sliding on said output shaft and used to transmit starting torque to an engine;

a bearing surface being formed on either said flange or side plate to allow the opposite contact to slide thereon;

a recess filled with grease being provided in said bearing surface.

2. A starting motor fitted with an epicycle reduction gear as claimed in claim 1, wherein said bearing surface is formed in such a manner as to protrude from said side plate.

3. A starting motor fitted with an epicycle reduction gear as claimed in claim 1, wherein said bearing surface is annular so that the rotary shaft is enclosed thereby.

4. A starting motor fitted with an epicycle reduction gear as claimed in claim 2, wherein said recess is an annular groove continuous along the whole outer periphery of the annular bearing surface.

5. A starting motor fitted with an epicycle reduction gear as claimed in claim 3, wherein said annular groove is made up in the form of a wave.

* * * * *